United States Patent [19]

Oswalt et al.

[11] 4,165,024

[45] Aug. 21, 1979

[54] BULK SHIPPING CONTAINER

[75] Inventors: Leon M. Oswalt, Guthrie; Jimmie D. McClanahan, Oklahoma City, both of Okla.

[73] Assignee: Cato Oil and Grease Co., Oklahoma City, Okla.

[21] Appl. No.: 831,867

[22] Filed: Sep. 9, 1977

[51] Int. Cl.[2] ..... B65D 77/06

[52] U.S. Cl. ..... 222/105; 222/181; 206/386; 220/4 F; 220/404

[58] Field of Search ..... 222/105, 185, 131, 183, 222/464, 540, 173, 180, 181; 229/17 B; 206/386; 217/43 A; 220/403, 404, 465, 461, 4 F, 5 R, 5 A, 7; 221/283

[56] References Cited

U.S. PATENT DOCUMENTS

| | | | |
|---|---|---|---|
| 1,111,054 | 9/1914 | Bonneville | 220/4 F |
| 2,121,511 | 6/1938 | Schlesinger | 220/5 R X |
| 2,864,098 | 12/1958 | Lorimer | 220/5 A |
| 3,372,725 | 3/1968 | Voorhees | 222/105 X |
| 3,384,106 | 5/1968 | Isbrandtsen | 220/403 X |
| 3,433,400 | 3/1969 | Hawkins | 222/185 X |
| 3,785,534 | 1/1974 | Smith | 229/17 B X |
| 3,972,454 | 8/1976 | Croley | 229/17 B X |
| 3,980,196 | 9/1976 | Paulyson et al. | 220/404 X |

FOREIGN PATENT DOCUMENTS

| | | | |
|---|---|---|---|
| 152770 | 6/1950 | Sweden | 222/464 |

*Primary Examiner*—Robert J. Spar
*Assistant Examiner*—Edward M. Wacyra
*Attorney, Agent, or Firm*—William G. Addison

[57] ABSTRACT

This invention relates to an improved reuseable bulk shipping container for the transport of liquids, semi-liquids, semi-solids, pastes and the like. The container has a pallet-type base structure including a drain and flow regulation valve assembly provided with a quick connect-disconnect coupling for connection to an exterior pumping source and a base retainer ring located on the base structure adapted to support the base of a side structure. The side structure includes removable metal panels or the like, and support structure to maintain the panels in a cylindrical form. A disposable inner liner is provided for containing the product. A top liner support bar, a top retaining ring cover structure and connecting rods are provided to secure the structure to the pallet-type base structure.

5 Claims, 4 Drawing Figures

BULK SHIPPING CONTAINER

BACKGROUND OF THE INVENTION

1. Field of the Invention

This invention relates to reuseable containers for bulk shipping of materials such as liquids, semi-liquids, pastes, semi-solids and the like.

2. Description of the Prior Art

Bulk shipments of liquids, semi-liquids, pasty materials and the like have been made for many years. The disadvantages of the known methods of shipping such materials have been:

1. the size of the filled and empty shipping container;
2. difficulty of removing the product from the container;
3. loss of product or waste as a direct result of the inability to remove substantially all the material shipped from the container;
4. the expense of cleaning the container to eliminate later contamination of other products upon reuse;
5. the necessity of considerable amounts of manual handling causing high labor costs and the possibility of personal injury to employees;
6. the expense of manufacturing specially designed containers; and
7. the expense of returning the shipping container to the product manufacturer for reutilization, if return is possible.

Thus, it would be advantageous to provide a bulk shipping container which would overcome or, at least, substantially minimize these prior art disadvantages.

SUMMARY OF THE PRESENT INVENTION

The present invention comprises a cylindrical shipping container mounted on a pallet-type base structure with a disposable interior lining (to be more fully described hereinafter) from which in excess of 97.5 percent the product can be emptied by pumping. In many instances, the product recovery will exceed 99.9 percent.

Further, the cylindrical shipping container can be easily disassembled for return to the shipper and reutilization.

Some of the benefits of the present invention over prior bulk shipping container designs are:

1. less product is lost by the consumer as non-recoverable waste in the bulk shipping container, thus the cost per pound of usable product is lower;
2. the product does not require direct manual handling when transferred from the bulk shipping container, thus labor costs are reduced;
3. the product is not contaminated by re-use of the bulk shipping container as a disposable interior liner is utilized;
4. after the product is removed from the bulk shipping containers, the containers can be disassembled and stacked for return to the shipper;
5. the volume of space occupied by a disassembled container represents approximately 17 percent of volume occupied by a filled container, thus more containers can be stored for reshipment in a smaller area;
6. the expense of manufacturing the bulk shipping container is less than the expense normally incurred in manufacturing specially designed bulk shipping containers; and 7. the expense for return of the bulk shipping container for reutilization is reduced as less volume is occupied by the disassembled container and the total weight of a return shipment of the disassembled containers is less than that of previously known bulk shipping containers.

Further advantages of the apparatus of the present invention will be more fully explained in the description of the preferred embodiments and examples which follow.

DESCRIPTION OF THE PREFERRED EMBODIMENT

Figure 1:
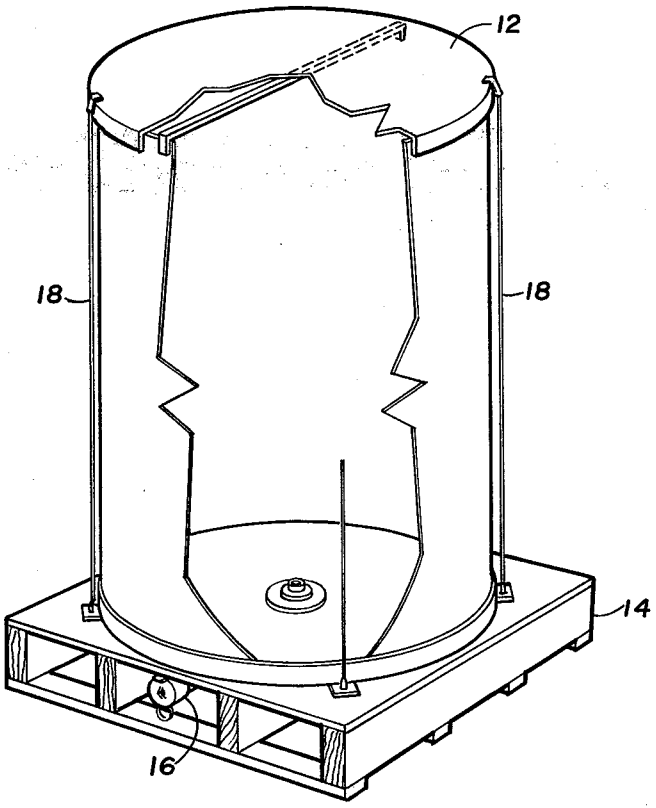
FIG. 1, is a three-dimensional cutaway view of the container of the present invention.

Turning now to FIG. 1, a three-dimensional cutaway view of one suitable means of constructing the apparatus of the present invention is shown including a bulk shipping container 12, a pallet-type base structure 14, a drain and flow regulation valve assembly 16, and bulk shipping container top securing members 18.

Figure 2:
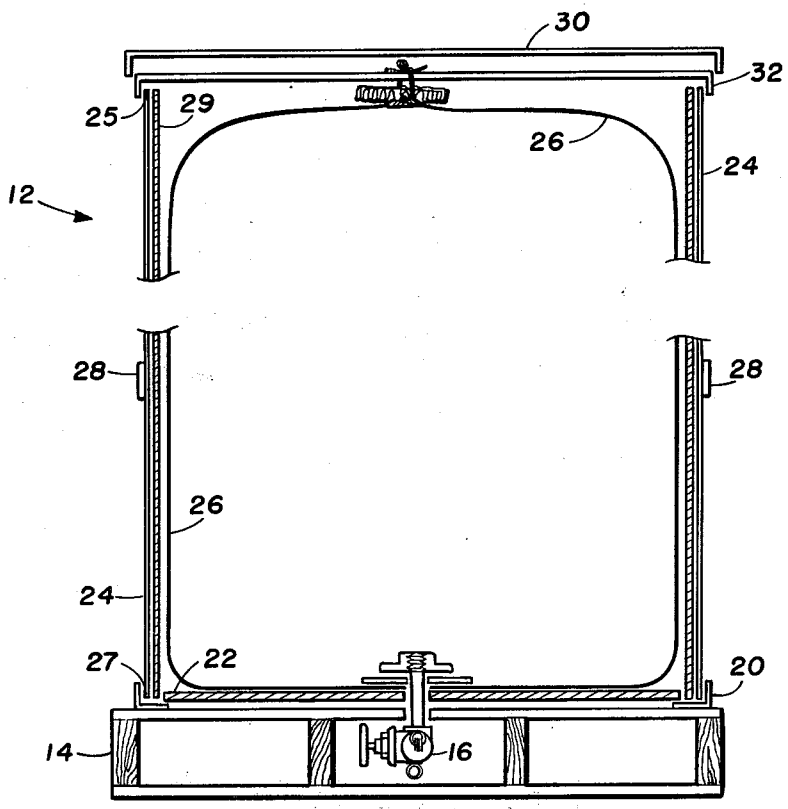
FIG. 2, is an enlarged, detailed cross-sectional view of a pallet-type base structure, drain assembly, and interior disposable liner for the bulk shipping container of this invention.

Turning now to FIG. 2, an enlarged, detailed, cross-sectional view of the pallet-type base structure 14 and bulk shipping container 12 is illustrated.

The pallet-type base structure 14 can be of any type of construction as is commonly known to those experienced in the art such that the pallet is capable of being moved by mechanical means such as, for example, by a forklift. Alternatively, it can be specifically constructed for use only with bulk shipping container 12.

Bulk shipping container 12 includes a base retainer ring 20 which can be fixedly attached to the structure 14 (although it is not necessary to the satisfactory performance of the bulk shipping container) a support disc 22, a side structure 24 having a top edge 25 and a bottom edge 27, a disposable inner liner 26, a side structure support band 28, a top retaining ring cover structure 30 and a liner support bar 32.

As previously stated, the base retainer ring 20 is placed on the pallet-type base structure 14 and may be either fixedly attached or moveable thereon. A passageway is located generally in the center of the area encompassed by base retainer ring 20 through the structure 14 to enable attachment of the drain conduit and flow regulation valve assembly 16 to the bulk shipping container 12.

Thereafter, in one embodiment of the present invention, support disc 22 is placed within the base retainer ring 20 and a corresponding passageway is made therethrough in direct alignment with the passageway in pallet-type support structure 14. The disposable inner liner 26 then is located upon the support disc 22 and a passageway smaller in diameter than the passageway through disc 22 is provided in direct alignment with the passageway through disc 22 and support structure 14. The drain conduit and flow regulation valve assembly 16 then is inserted through the communicating passageway formed through the pallet-type base structure 14, support disc 22 and disposable inner liner 26 and fixedly attached to sealably engage the disposable inner liner 26 within the bulk shipping container 12 by means to be more fully described hereinafter.

In the event that pallet-type base structure 14 is specially constructed for use with bulk shipping container 12, support disc 22 can be deleted if the base structure 14 has a relatively smooth continuous surface in contact with the disposable inner liner 26.

The bottom edge 27 of side structure 24 then is inserted into the base retainer ring 20 and the side structure support band 28 is attached to insure that the container is retained in a uniform cylindrical shape after it has been filled with product. The side structure 24 provides support for the sides of the disposable inner liner 26 in contact therewith. The side structure 24 is comprised of at least one metal panel which interlocks or otherwise connects such that a cylindrical shape can be produced therefrom upon flexing the metal panel. The side structure 24 can also comprise, for example, two metal panels which are hinged on one end and provided with a hasp on the other end to lock the panels in the cylindrical shape or metal panels which are hinged on one end and provided with a door-hinge type tapered slip bolt and locking cotter pin to hold the bolt on the other end or any other type of fastening device such that the panels are capable of being joined together to form a cylindrical shape. Alternatively, the side structure 24 can be composed of any other type material capable of forming a cylindrical shape upon flexing and which will provide support for the disposable inner liner 26 contained within said cylindrical shape. Also, the interior surface of the side structure 24 can be provided with an additional liner 29 to protect the disposable inner liner 26 in the event the interior surface of the side structure 24 is such that a puncture of the disposable inner liner 26 could occur as a result of damage to the side structure. Liner 29 can be constructed of, for example, corrugated paper or any other materials known to the art.

The disposable inner liner 26 then is filled with the liquid, semi-liquid, semi-solid, or paste consistency material and the like in preparation for shipping. The disposable inner liner 26 is filled from either the top or the bottom end of the bulk shipping container 12. After filling, the disposable inner liner 26 is sealed at its top end in any suitable manner such that air is excluded from contact or communication with the material contained therein. This sealing procedure can be accomplished, for example, by twisting the top of the disposable, inner liner 26 such that the liner is caused to contract upon the material contained therein, and the liner then is tied with a wrapping material such as nylon twine or the like. The sealed end of the disposable inner liner 26 then is attached by suitable means to liner support bar 32 or any other suitable support structure which extends across the top of the interior of the cylinder formed by side support structure 24. The liner support bar 32 is attached to the side support structure 24 by any suitable means known to those skilled in the art such that it extends substantially across the diameter of the cylinder.

Figure 4:
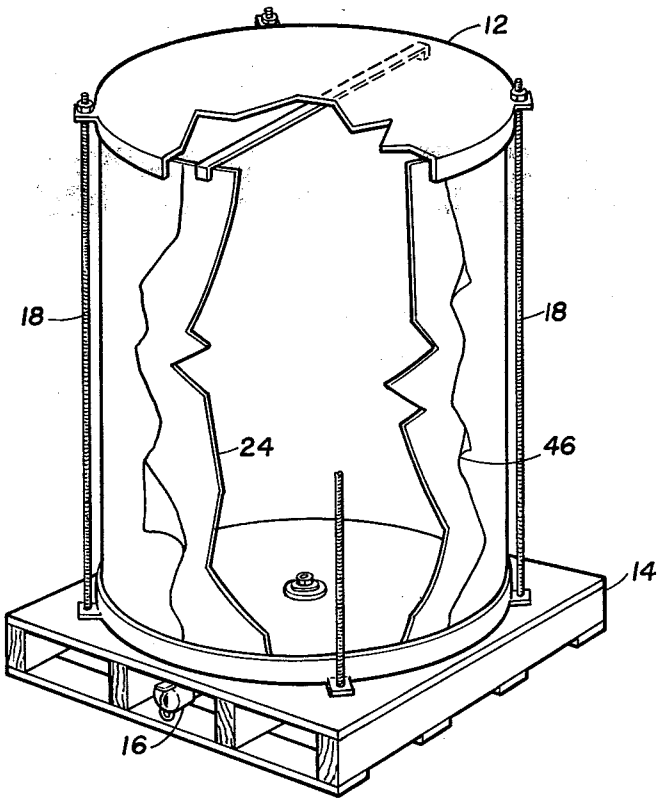
FIG. 4, is a three-dimensional cutaway view of an alternate embodiment of the container of the present invention.

The top retaining ring cover structure 30 then is placed upon the upper end of the cylinder formed by the top edge 25 of side support structure 24 and attached by top securing members 18. Typically, top securing member 18 can be cables with tensioning means (FIG. 1) or continuous threaded rods with end nuts (FIG. 4) to which the top retaining ring cover structure 30 is attached by means of anchor rings, bolt connections or other means of connection well known by those skilled in the art such that the cover structure is secured to the bulk shipping container 12 and pallet-type base structure 14.

Figure 3:
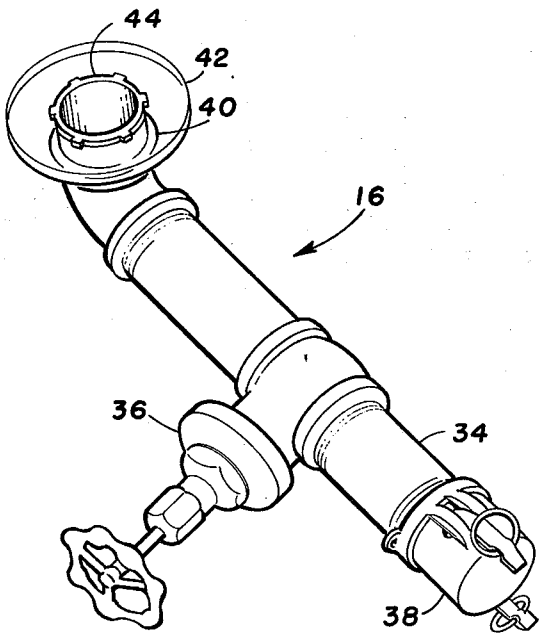
FIG. 3, is an enlarged view of a drain conduit and flow regulation valve assembly for the container of this invention.

Turning now to FIG. 3, an enlarged view of the drain conduit and flow regulation valve assembly 16 is illustrated. Assembly 16 comprises a drain conduit 34, a flow regulation valve 36, a quick connect-disconnect conduit coupling and dust cover 38, a lower sealing ring 40 fixedly attached to the drain conduit 34, an upper removable sealing ring 42, and a sealing nut 44. To install the assembly 16 in the communicating passage formed through pallet-type base structure 14, support disc 22 and disposable inner liner 26, the end of drain conduit 34 near which lower sealing ring 40 is attached is inserted through the passageway. This portion of drain conduit 34 is provided with suitable pipe threading such that upper sealing ring 42 can be placed over the end of the drain conduit 34 extending into the bulk shipping container 12 and be sealably mounted thereon by installation of the sealing nut 44. The sealing nut 44 then is advanced to a position on the end of drain conduit 34 such that the removable sealing ring 42 sealably engages the interior of the disposable iner lining 26 and forms a passage therefrom such that the product contained within the bulk shipping container 12 can be removed from the container by attachment of the drain conduit 34 to suitable pumping means and opening valve 36.

The top of disposable inner liner 26 is attached to liner support bar 32 such that when the bulk shipping container 12 is emptied by drain conduit and flow regulation valve assembly 16, via the pumping process, the liner is allowed to collapse upon itself thereby providing a continuous feed of the product contained therein. As a result, in excess of 97.5 percent of the product can be removed from the bulk shipping container 12 for use by the consumer. The quantity of recoverable product can exceed 99.9 percent in the event of manual assistance following primary removal of the product by pumping.

To recover the product remaining in the disposable inner liner 26 after pumping, if any, the top retaining ring cover structure 30 is removed by releasing the top securing members 18 and one of the panels comprising side support structure 24 is removed to enable additional manual collapses of the disposable inner liner 26 such that any residual product enters the drain conduit and flow regulation valve assembly 16.

In one preferred embodiment of the present invention, the exterior of the side support structure 24 is covered with a disposable paper or other suitable material to provide a sheath 46 around the bulk shipping container 12 (FIG. 4) upon which the product name, shipping instructions or other forms of identification or information can be placed, as required. Thereafter, upon disassembly, this sheathing can be discarded and upon reuse of the shipping container, new material can be attached for providing new information.

To more fully disclose the beneficial and innovative aspects of the present invention, the following examples are provided to contrast the bulk shipping container of the present invention with those conventionally used in the bulk shipping of liquid, semi-liquid, paste consistency and semi-solid products and the like in tractor trailer sized lots. For purposes of the following examples, the product is a grease material. Further, the bulk shipping container of the present invention comprises a cylindrical container formed by two metal panels approximately 5 feet by 6 feet. The panels are assembled to form a cylinder approximately 5 feet high and approximately 3.8 feet in diameter which is mounted upon a pallet-type base structure approximately 4 feet by 4 feet and approximately 4 inches high. The total volume occupied by the assembled bulk shipping container is approximately 88 cubic feet.

EXAMPLE 1

A trailer load of the bulk shipping containers of the present invention will comprise 14 containers, each having a tare weight of 242 pounds and 3000 pounds of product per container, or a total shipment of 42,000 pounds of product. At the point of use, the product is pumped from the containers without manual assistance in draining the disposable inner liner, it is found that 63 pounds of product remain in each container. This represents a loss of only 2.1 percent of the product. The volume occupied by the disassembled units for back-haul to shipper for reuse comprises 209 cubic feet, approximately 17 percent of the original assembled volume.

EXAMPLE 2

When manual assistance is provided in draining the product from the disposable inner liner, only 2 pounds of product remain in each container which represents a loss of only 0.07 percent of the product. The volume of the disassembled units on back-haul is the same as Example 1.

EXAMPLE 3

A trailer load of 400 pound rigid metal drums will comprise 100 units each having a tare weight of 50 pounds and 400 pounds of product per unit, or a total shipment of 40,000 pounds of product. At the point of use, the product is pumped from the drum, and it is found that 50 pounds of product remain in each drum. This represents a loss of 12.5 percent of the product. The volume occupied by the units for back-haul to the shipper for reuse comprises 817 cubic feet, the same as the original volume.

EXAMPLE 4

When the drums are provided with internal follower plates to scrape the sides of the drum, 5 pounds of product remain in each drum which represents a loss of 1.25 percent of the product. The volume occupied on back-haul is the same as Example 3.

EXAMPLE 5

A trailer load of 4000 pound rigid bulk shipping containers will comprise 9 units each having a tare weight of 700 pounds and 4000 pounds of product per unit, or a total shipment of 36,000 pounds of product. At the point of use, the product is pumped from the rigid container, and it is found that 400 pounds of product remain in each container. This represents a loss of 10 percent of the product. As a result of the large size of the rigid containers, no back haul of other material is possible.

EXAMPLE 6

A rigid metal gondola or hopper trailer load of material has an individual tare weight of 18,900 pounds and a total product capacity of 37,000 pounds. At the point of use, the product is pumped from the trailer, and it is found that 1300 pounds of product remains in the container. This represents a loss of 3.5 percent of the product to the consumer. The empty trailer is hauled back for another load, no back-haul of other material is possible.

Thus, it is readily apparent that the present invention provides a superior bulk shipping container in that more product can be shipped and less product is lost as non-recoverable waste in a bulk shipment, thereby reducing the total cost per pound of the delivered product to the consumer. Futher, the expense of returning the disassembled units is less than that for the back-haul of other shipping containers since less volume is occupied by the disassembled containers and the total weight of a return shipment of the disassembled containers is less than that of other shipping containers.

While the subject invention has been described in what is presently contemplated as the preferred embodiment thereof, it is to be understood that changes or modifications of the apparatus can be made without departing from the spirit or scope of the invention as defined by the following claims.

What is claimed is:

1. A bulk shipping container which comprises:
   - a base structure;
   - a side wall structure, at least a portion of which is removable, having a top edge and a bottom edge;
   - a side wall retainer structure located upon the base structure, said retainer structure adapted to receive the bottom edge of said side wall structure;
   - a disposable inner liner located within said side wall structure;
   - a drain conduit and flow regulation valve assembly positioned such that one end of said conduit is in sealed engagement with the interior of the disposable inner liner such that a product material to be contained therein can be removed therefrom;
   - a top cover structure removably mounted upon the top edge of the side wall structure to seal the container;
   - a liner support bar positioned in such manner as to extend substantially across the top of the side wall structure beneath the top cover structure to support the disposable inner liner; and
   - means for removably securing the assembled top cover structure, side wall structure and side wall retainer structure to the base structure.

2. The bulk shipping container of claim 1 wherein said means for removably securing the top cover structure, side wall structure and side wall retainer structure to the base structure is defined further as:
   cables with tensioning means.

3. The bulk shipping container of claim 1 wherein said means for removably securing the top cover structure, side wall structure and side wall retainer structure to the base structure is defined further as:
   continuous threaded rods with end nuts.

4. The bulk shipping container of claim 1 defined further to include:
   - a support band positioned such that the side wall structure of the container is retained in a uniform cylindrical shape.

5. The bulk shipping container of claim 1 defined further to include:
   - an outer sheath of disposable material positioned about the side wall structure for printing shipping information thereon.

* * * * *